United States Patent [19]

Mattsson

[11] Patent Number: 4,529,326

[45] Date of Patent: Jul. 16, 1985

[54] PRINT HAMMER FOR PRINTERS AND TYPEWRITERS

[75] Inventor: Sten I. Mattsson, Mörrum, Sweden

[73] Assignee: Facit Aktiebolag, Atvidaberg, Sweden

[21] Appl. No.: 580,278

[22] Filed: Feb. 17, 1984

Related U.S. Application Data

[63] Continuation of Ser. No. 414,374 filed as PCT SE 82/00013, Jan. 19, 1982, published as WO 82/02517, Aug. 5, 1982, § 102 (e) date Aug. 27, 1982, abandoned.

[30] Foreign Application Priority Data

Jan. 19, 1981 [SE] Sweden ..... 8100273

[51] Int. Cl.[1] ..... B41J 9/38; B41J 9/42

[52] U.S. Cl. ..... 400/157.2; 400/167; 400/686; 101/93.02; 101/93.48; 335/255

[58] Field of Search ..... 400/157.2, 167, 686, 400/687, 157.3, 339, 341; 101/93.02, 93.04, 93.48; 335/240, 255, 257–262, 263, 271, 277; 251/48, 55, 129; 188/316; 16/84

[56] References Cited

U.S. PATENT DOCUMENTS

| | | | |
|---|---|---|---|
| 1,437,724 | 12/1922 | Creveling | 335/240 X |
| 1,931,178 | 10/1933 | Carlson | 16/84 |
| 1,995,620 | 3/1935 | Monroe | 188/316 X |
| 3,828,911 | 8/1974 | Soderstrom | 400/686 X |
| 4,044,323 | 8/1977 | Sleger | 335/240 |

FOREIGN PATENT DOCUMENTS

| | | | |
|---|---|---|---|
| 2261410 | 7/1974 | Fed. Rep. of Germany | 400/686 |
| 142316 | 6/1980 | German Democratic Rep. | 101/93.48 |
| 696,221 | 8/1953 | United Kingdom | 335/240 |

OTHER PUBLICATIONS

IBM Technical Disclosure Bulletin, vol. 22, No. 4, Sep. 1979, pp. 1318–1319. "Self Cooled Pivot Hammer", by Mathews.

*Primary Examiner*—Edgar S. Burr
*Assistant Examiner*—Charles A. Pearson
*Attorney, Agent, or Firm*—Burns, Doane, Swecker & Mathis

[57] ABSTRACT

A print hammer for printers and typewriters comprises a hammer rod (11) which is axially movable in a housing (17, 18). The hammer rod is biassed towards a rest position by a spring and can be moved to a print position by a drive means, for example a solenoid coil (19). The hammer rod delimits a room (31) in the housing the size of which increases during the movement of the hammer rod towards the print position. The room (31) is connected to the surrounding atmosphere via a narrow channel (33) and also via a valve means (25, 28) which is open during the movement to the print position but closed during the return movement to the rest position. The valve means (25, 28) also forms a stop member for the hammer rod (11) in the rest position.

5 Claims, 3 Drawing Figures

PRINT HAMMER FOR PRINTERS AND TYPEWRITERS

This application is a continuation of application Ser. No. 414,374, filed as PCT SE 82/00013, Jan. 19, 1982, published as WO 82/02517, Aug. 5, 1982, § 102(e) date Aug. 27, 1982, now abandoned.

The present invention refers to a print hammer for printers and typewriters of the kind having a hammer rod that is axially reciprocable in a housing and which is normally biassed to a rest position. The movement of the hammer rod to the rest position is dampened by a device comprised of a piston that moves within a recess and defines a substantially closed cylinder whose size changes in dependence on the position of the piston.

A print hammer of the kind referred to is used for example in a typewriter to strike a type character to move it into contact with a recording medium in order to reproduce the character on said medium. The type character may be selected, for instance, from a number of characters disposed along the periphery of a type disc.

The print hammer comprises a hammer rod which is movable backwards and forwards in a housing. Biassing means operate the hammer rod to a rest position and drive means operate the hammer rod to a print position. When returning to the rest position the hammer rod normally hits a stop member and the remaining kinetic energy causes the hammer to bounce and to start moving again towards the print position. In order to prevent such bouncing the return movement of the hammer rod must be dampened to such extent that almost no kinetic energy remains when the hammer rod hits the stop member.

The object of the invention is to provide a print hammer of the kind referred to which has been provided with a damping device which dampens the return movement of the hammer rod in a simple and reliable way. The object is achieved with a print hammer having the piston being constituted by the rear end of the hammer rod, and a one-way valve provided in the closed cylinder to admit air into the cylinder during a printing stroke of the hammer and to inhibit the escape of air from the cylinder during a return stroke.

Figure 1:
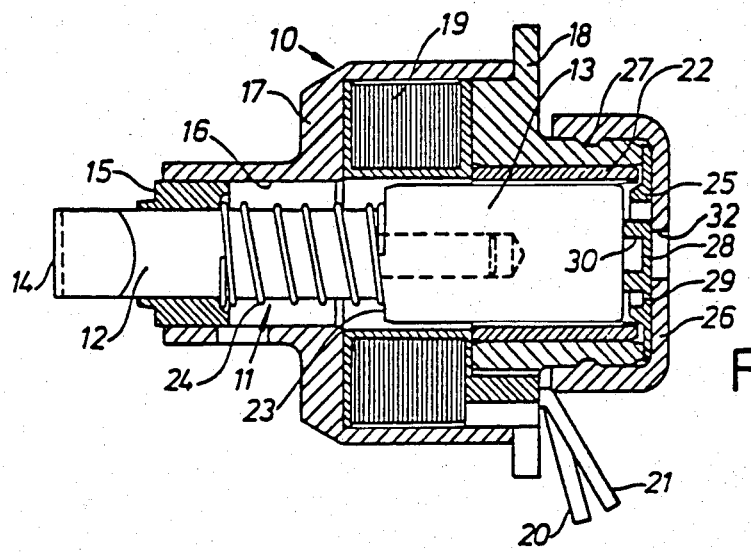
Figure 2:
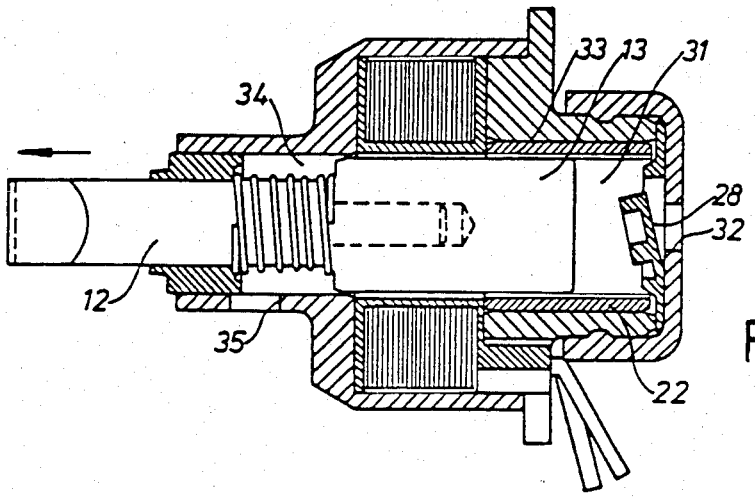
Figure 3:
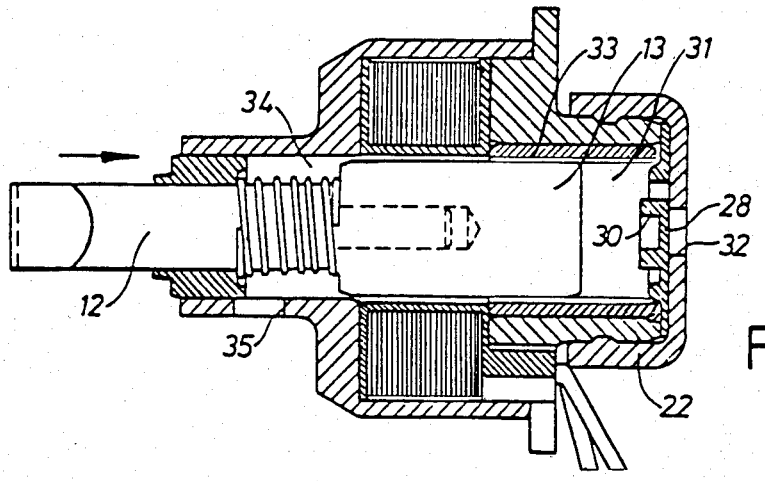

The invention will now be described in detail with reference to the accompanying drawings in which FIGS. 1-3 show a print hammer according to the invention in section and with the hammer rod in different positions. In FIG. 1 the hammer rod is in its rest position. In FIG. 2 the hammer is moving towards the print position and in FIG. 3 the hammer rod is shown in a position during the return movement towards the rest position.

In the illustrated embodiment an electromagnetically driven hammer will be described which generally is referred to by the numeral 10. A hammer rod 11 comprises a front part 12 of non- magnetic material and a rear part 13 connected to the front part and made from magnetic material. The front part 12 has an impact surface 14 intended to cooperate with a selected one of a number of type characters disposed along the periphery of a type disc also called daisy wheel. Such a type disc is commonly known and is not shown in the drawing. Moreover, the front part 12 is journalled in a slide bearing 15 which has been pressed into a hole 16 in a front housing part 17 which with a rear housing part 18 forms a hammer housing. The part 18 is pressed into the part 17 securing between them a coil 19 which can be electrically connected via two terminals 20,21. A slide bearing 22 pressed into the housing part 18 forms a bearing for the rear part 13 of the hammer rod 11. The rear part 13 has greater diameter than the front part 12 of the hammer rod 11 and has a shoulder 23. Between the shoulder 23 and the slide bearing 15 is provided a helical spring 24 which biasses the hammer rod 11 towards its rest position, as shown in FIG. 1.

A valve device comprises a disc 25 which is jammed against the housing part 18 by a cover 26 that is fixed to the housing part by a snap fastening arrangement 27 consisting of a ring-shaped bulge in the cover and a correspondingly shaped groove in the housing part 18. A central valve disc 28 is cut out in the disc 25 of the valve device, said disc being circular in shape and being connected to the disc 25 by a narrow strip 29. An annular projection 30 on the valve disc 28 forms a stop member against which bears the part 13 when in rest position. The valve disc 28 with the annular projection 30 is made of elastic material, preferably a plastics material. Thereby, the valve disc by compression of the annular projection 30 can take up the kinetic energy that may reamin stored in the hammer rod 11 when reaching the rest position.

During the movement of the hammer rod towards the print position a room 31 is formed the size of which changes during this movement to be at a maximum when the hammer rod reaches the print position. Through a hole 32 provided in the cover 26 air may be introduced into the room 31. A narrow annular channel 33 provided between the slide bearing 22 and the rear part 13 of the hammer rod interconnects the room 31 with a room 34 delimited by the hole 16 and the front part 12 of the hammer rod. The room 34 is connected to the surrounding atmosphere by an opening 35.

The above print hammer and the dampening device function in the following way.

In FIG. 1 the hammer rod 11 has taken its rest position in which the part 13 by the spring 24 is operated to bear on the annular projection 30, at the same time operating the valve disc 28 to close the hole 32.

FIG. 2 illustrates the course following the activation of the coil 19. The hammer rod 11 is driven to the left towards the print position against the action of the spring 24. Upon the movement of the hammer rod a vacuum will be created behind the rear part 13 of the rod and this vacuum operates the valve disc 28 to open the hole 32 to let air flow into the room 31 to fill it. The degree of filling is at its maximum when the hammer rod has reached it print position.

As shown in FIG. 3, after the hammer has hit the type character, the return movement starts and the hammer rod is now driven by the kinetic energy that remains after printing and by the action of the spring 24. The air volume trapped in the room 31 will be compressed creating an overpressure that operates the valve disc 28 to close the hole 32. During the continued return movement the air volume will be more and more compressed and because air is permitted to leave the room 31 only through the narrow channel 33 the movement will be damped and when the hammer rod reaches the rest position most of the kinetic energy has been exhausted. The small rest energy that may still remain when the rod has reached the rest position is taken up by the valve disc 28 by compression of the annular projection 30.

The embodiment described above and shown in the drawing is not intended restrict the invention in any way, the scope of which will be determined only by the appended claims. For instance, the electromagnetic drive means described may be replaced by a drive means of a different kind without deviating from the inventive idea.

I claim:

1. A print hammer for printers and typewriters, comprising:

a housing having a cylinder therein;

a hammer rod that is axially reciprocable in said housing, one end of said rod forming a piston that is disposed in said cylinder;

means for normally biasing said hammer rod to a rest position;

drive means for translating said hammer rod from said rest position to a print position; and means for damping the return movement of said hammer rod from the print position to said rest position, said damping means including a narrow annular channel that is formed by a clearance between said piston and a slide bearing which surrounds said piston and that provides access to a surrounding atmosphere, and a movable valve disc which selectively covers an opening in said housing that forms a connection between said cylinder and the atmosphere, said valve disc and said opening each being circular in shape, said annular channel being sufficiently narrow to limit access to the atmosphere such that movement of the hammer rod toward said print position results in a vacuum being created in said cylinder that causes said valve to open said connection and movement of the hammer toward said rest position creates a high pressure that causes said valve to close said connection and substantially enclose a portion of said cylinder defined by the end surface of said piston, said valve disc and said slide bearing, to thereby dampen movement of said piston, said valve disc having an annular projection disposed on the side opposite said opening and forming a stop member against which said hammer rod abuts when in its rest position.

2. The print hammer of claim 1 wherein said hammer rod comprises a rear portion and a front portion of reduced diameter such that an annular room is provided between said front portion and the wall of said cylinder, said room connecting said channel to the surrounding atmosphere.

3. The print hammer of claim 1 wherein said valve is comprised of a circular disk with said valve disk being centrally located on said circular disk and connected thereto at one point by a narrow strip, and further including a cover having said opening therein, said cover being mounted on said housing and said circular disk being sandwiched between said housing and said cover to thereby secure said circular disk to said housing.

4. The print hammer of claim 1 wherein said valve disc is made of an elastic material.

5. The print hammer of claim 4 wherein said valve is comprised of a circular disk with said valve disk being centrally located on said circular disk and connected thereto at one point by a narrow strip, and further including a cover having said opening therein, said cover being mounted on said housing and said circular disk being sandwiched between said housing and said cover to thereby secure said circular disk to said housing.

* * * * *